US005774854A

United States Patent [19]

Sharman

[11] Patent Number: 5,774,854

[45] Date of Patent: Jun. 30, 1998

[54] TEXT TO SPEECH SYSTEM

[75] Inventor: Richard Anthony Sharman, Southampton, United Kingdom

[73] Assignee: International Business Machines Corporation, Armonk, N.Y.

[21] Appl. No.: 343,304

[22] Filed: Nov. 22, 1994

[30] Foreign Application Priority Data

Jul. 19, 1994 [GB] United Kingdom ..... 9414539

[51] Int. Cl.[6] ..... G10L 5/02; G10L 9/00

[52] U.S. Cl. ..... 704/260; 704/268; 395/200.33

[58] Field of Search ..... 395/2.69, 495, 395/496, 872, 467, 200; 381/52

[56] References Cited

U.S. PATENT DOCUMENTS

| | | | |
|---|---|---|---|
| 4,672,535 | 6/1987 | Katzman et al. | 395/858 |
| 4,754,485 | 6/1988 | Klatt | 381/52 |
| 4,961,132 | 10/1990 | Uehara | 364/200 |
| 5,167,035 | 11/1992 | Mann et al. | 395/575 |
| 5,179,699 | 1/1993 | Iyer et al. | 395/650 |
| 5,329,619 | 7/1994 | Page et al. | 395/200 |
| 5,396,577 | 3/1995 | Oikawa et al. | 395/2.69 |

FOREIGN PATENT DOCUMENTS

| | | | |
|---|---|---|---|
| 0582377A2 | 2/1994 | European Pat. Off. | G10L 5/02 |

OTHER PUBLICATIONS

European Search Report, EP 95 30 1164, Aug. 21, 1997.

Higuchi et al., "A Portable Text–To–Speech System Using A Pocket–Sized Formant Speech Synthesizer", IEICE Transactions on Fundamentals of Electronics, Communications and Computer Sciences, vol. 76A, No. 11, Nov. 1, 1993, pp. 1981–1989.

*Primary Examiner*—David R. Hudspeth
*Assistant Examiner*—Patrick N. Edduard

[57] ABSTRACT

The text to speech (TTS) system comprises two main components, a linguistic processor and an acoustic processor. The former is responsible for receiving an input text, and breaking it down into a sequence of phonemes. Each phoneme is assigned a duration and pitch. The acoustic processor is then responsible for reproducing the phonemes, and concatenating them into the desired acoustic output. The TTS system is driven from the output in that the linguistic processor does not operate until it receives a request from the acoustic processor for input. This request, and a return message that it can now be satisfied, are routed via a process dispatcher. By driving the system from the output, the system can be accurately halted in the event that the acoustic output needs to be interrupted.

9 Claims, 4 Drawing Sheets

TEXT TO SPEECH SYSTEM

The present invention relates to a text to speech system for converting input text into an output acoustic signal imitating natural speech.

Text to speech systems (TTS) create artificial speech sounds directly from text input. Conventional TTS systems generally operate in a strictly sequential manner. The input text is divided by some external process into relatively large segments such as sentences. Each segment is then processed in a predominantly sequential manner, step by step, until the required acoustic output can be created. Examples of TTS systems are described in "Talking Machines: Theories, Models, and Designs", eds G Bailly and C Benoit, North Holland 1992; see also the paper by Klatt entitled "Review of text-to-speech conversion for English" in Journal of the Acoustical Society of America, vol 82/3, p 737–793, 1987.

Current TTS systems are capable of producing voice qualities and speaking styles which are easily recognized as synthetic, but intelligible and suitable for a wide range of tasks such as information reporting, workstation interaction, and aids for disabled persons. However, more widespread adoption has been prevented by the perceived robotic quality of some voices, errors of transcription due to inaccurate rules, and poor intelligibility of intonation-related cues. In general the problems arise from inaccurate or inappropriate modelling of the particular speech function in question. To overcome such deficiencies therefore, considerable attention has been paid to improving the modelling of grammatical information and so on, although this work has yet to be successfully integrated into commercially available systems.

A conventional text to speech system has two main components, a linguistic processor and an acoustic processor. The input into the system is text, the output an acoustic waveform which is recognizable to a human as speech corresponding to the input text. The data passed across the interface from the linguistic processor to the acoustic processor comprises a listing of speech segments together with control information (e.g., phonemes, plus duration and pitch values). The acoustic processor is then responsible for producing the sounds corresponding to the specified segments, plus handling the boundaries between them correctly to produce natural sounding speech. To a large extent the operation of the linguistic processor and of the acoustic processor are independent of each other. For example, EPA 158270 discloses a system whereby the linguistic processor is used to supply updates to multiple acoustic processors, which are remotely distributed.

The architecture of conventional TTS systems has typically been based on a "sausage" machine approach, in that the relevant input text is passed completely through the linguistic processor before the listing of speech segments is transferred on to the acoustic processor. Even the individual components within the linguistic processor are generally operated in a similar, completely sequential fashion (for an acoustic processor the situation is slightly different in that the system is driven by the need to output audio samples at a fixed rate).

Such an approach is satisfactory for academic studies of TTS systems, but less appropriate for the real-time operation required in many commercial applications. Moreover, the prior art approach requires large intermediate buffers, and also entails much wasted processing if for some reason eventually only part of the text is required.

Accordingly, the invention provides a text to speech (TTS) system for converting input text into an output acoustic signal simulating natural speech, the text to speech system comprising a linguistic processor for generating a listing of speech segments plus associated parameters from the input text, and an acoustic processor for generating the output acoustic waveform from said listing of speech segments plus associated parameters. The system is characterized in that the acoustic processor sends a request to the linguistic processor whenever it needs to obtain a further listing of speech segments plus associated parameters, the linguistic processor processing input text in response to such requests.

In a TTS systems it is necessary to perform the linguistic decoding of the sentence before the acoustic waveform can be generated. Some of the detailed processing steps within the linguistic processing must also, of necessity, be done in an ordered way. For example, it is usually necessary to process textual conventions such as abbreviations into standard word forms before converting the orthographic word representation into its phonetic transcription. However, the sequential nature of processing in typical prior art systems has not been matched to the requirements of the potential user.

The invention recognizes that the ability to articulate large texts in a natural manner is of limited benefit in many commercial situations, where for example the text may simply be sequences of numbers (e.g., timetables), or short questions (e.g., an interactive telephone voice response system), and the ability to perform text to speech conversion in real-time may be essential. However, other factors, such as restrictions on the available processing power, are often of far greater import. Many of the current academic systems are ill-suited to meet such commercial requirements. By contrast, the architecture of the present invention is specifically designed to avoid excess processing.

Preferably, if the TTS system receives a command to stop producing output speech, this command is forwarded first to the acoustic processor. Thus for example, if the TTS process is interrupted (e.g., perhaps because the caller has heard the information of interest and put the phone down), then termination of the TTS process is applied to the output end. This termination then effectively propagates in a reverse direction back through the TTS system. Because the termination is applied at the output end, it naturally coincides with termination point dictated by the user, who hears only the output of the system, or some acoustically suitable breakpoint (e.g., the end of a phrase). There is no need to guess at which point in the input text to terminate, or to terminate at some arbitrary buffer point in the input text.

It is also preferred that the linguistic processor sends a response to the request from the acoustic processor to indicate the availability of a further listing of speech segments plus associated parameters. It is convenient for the acoustic processor to obtain speech segments corresponding to one breath group from the linguistic processor for each request.

In a preferred embodiment, the TTS system further includes a process dispatcher acting as an intermediary between the acoustic processor and the linguistic processor, whereby the request and the response are routed via the process dispatcher. Clearly it is possible for the acoustic processor and the linguistic processor to communicate control commands directly (as they do for data), but the use of a process dispatcher provides an easily identified point of control. Thus commands to start or stop the TTS system can be routed to the process dispatcher, which can then take appropriate action. Typically the process dispatcher maintains a list of requests that have not yet received responses in order to monitor the operation of the TTS system.

In a preferred embodiment, the acoustic processor or linguistic processor (or both) comprise a plurality of stages arranged sequentially from the input to the output, each stage being responsive to a request from the following stage to perform processing (the "following stage" is the adjacent stage in the direction of the output). Note that there may be some parallel branches within the sequence of stages. Thus the entire system is driven from the output at component level. This maximizes the benefits described above. Again, control communications between adjacent stages may be made via a process dispatcher. It is further preferred that the size of output varies across said plurality of stages. Thus each stage may produce its most natural unit of output; for example one stage might output single words to the following stage, another might output phonemes, whilst another might output breath groups.

Preferably the TTS system includes two microprocessors, the linguistic processor operating on one microprocessor, the acoustic processor operating essentially in parallel therewith on the other microprocessor. Such an arrangement is particularly suitable for a workstation equipped with an adapter card with its own DSP. However, it is also possible for the linguistic processor and acoustic processor (or the components therein) to be implemented as threads on a single or many microprocessors. By effectively running the linguistic processor and the acoustic processor independently, the processing in these two sections can be performed asynchronously and in parallel. The overall rate is controlled by the demands of the output unit; the linguistic processor can operate at its own pace (providing of course that overall it can process text quickly enough on average to keep the acoustic processor supplied). This is to be contrasted with the conventional approach, where the processing of the linguistic processor and acoustic processor are performed mainly sequentially. Thus use of the parallel approach offers substantial performance benefits.

Typically the linguistic processor is run on the host workstation, whilst the acoustic processor runs on a separate digital processing chip on an adapter card attached to the workstation. This convenient arrangement is straightforward to implement, given the wide availability of suitable adapter cards to serve as the acoustic processor, and prevents any interference between the linguistic processing and the acoustic processing.

Various embodiments of the invention will now be described by way of example with reference to the following drawings.

Figure 1:
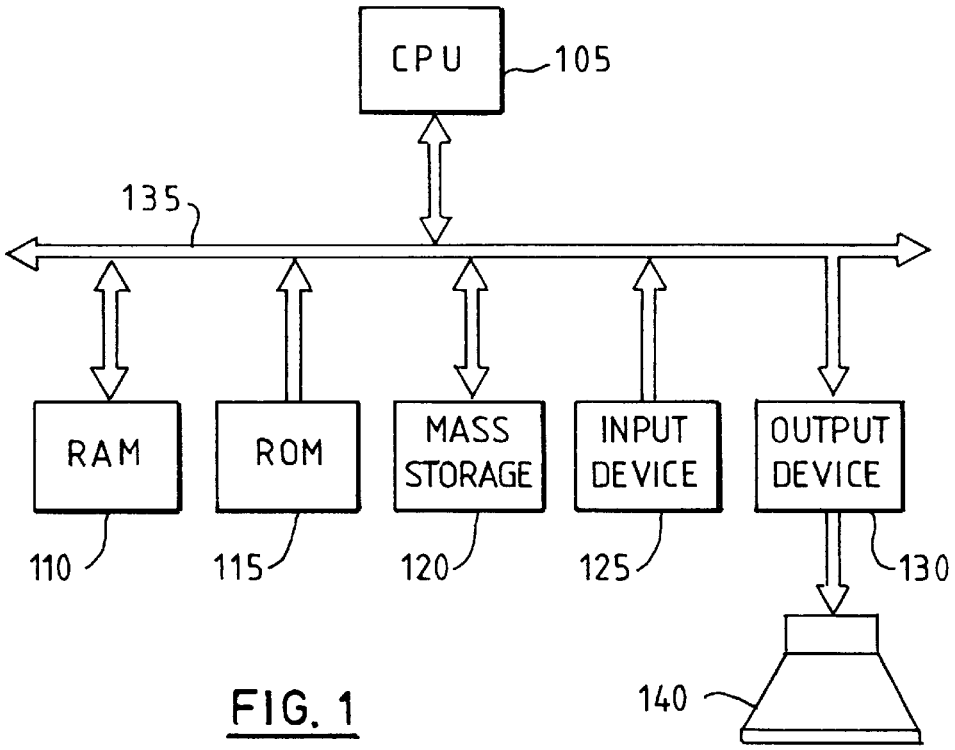
FIG. 1 is a simplified block diagram of a data processing system which may be used to implement the present invention.

FIG. 1 depicts a data processing system which may be utilized to implement the present invention, including a central processing unit (CPU) 105, a random access memory (RAM) 110, a read only memory (ROM) 115, a mass storage device 120 such as a hard disk, an input device 125 and an output device 130, all interconnected by a bus architecture 135. The text to be synthesized is input by the mass storage device or by the input device, typically a keyboard, and turned into audio output at the output device, typically a loud speaker 140 (note that the data processing system will generally include other parts such as a mouse and display system, not shown in FIG. 1, which are not relevant to the present invention). An example of a data processing system which may be used to implement the present invention is a RISC System/6000 equipped with a Multimedia Audio Capture and Playback (MACP) adapter card, both available from International Business Machines Corporation, although many other hardware systems would also be suitable.

Figure 2:
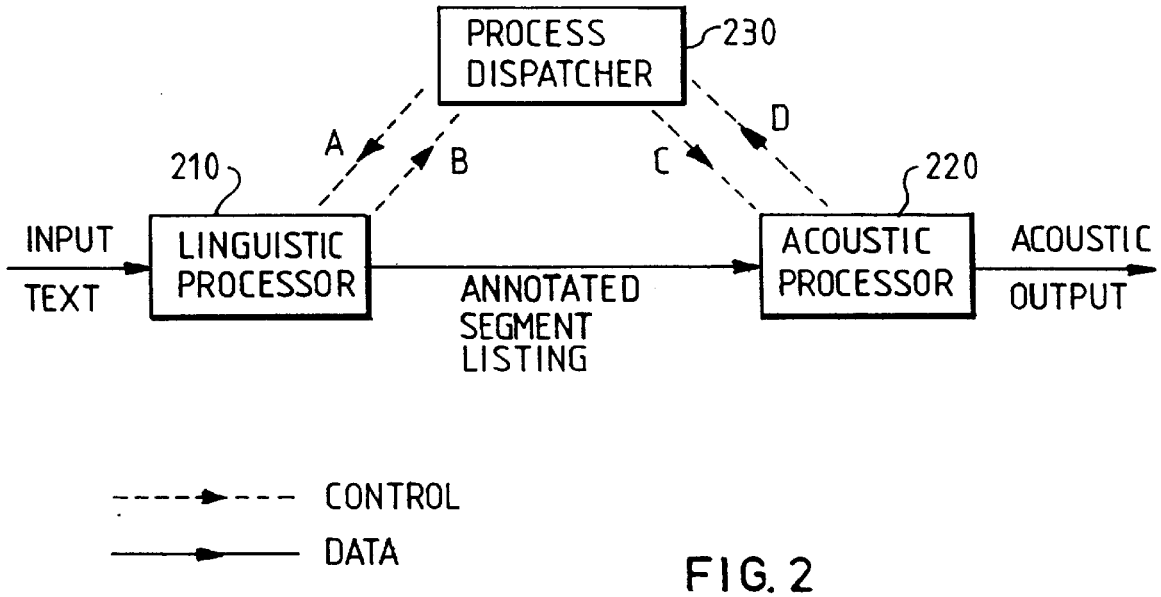
FIG. 2 is a high level block diagram of a real-time text to speech system in accordance with the present invention.

FIG. 2 is a high-level block diagram of the components and command flow of the text to speech system. As in the prior art, the two main components are the linguistic processor 210 and the acoustic processor 220. These are described in more detail below, but perform essentially the same task as in the prior art, i.e., the linguistic processor receives input text, and converts it into a sequence of annotated text segments. This sequence is then presented to the acoustic processor, which converts the annotated text segments into output sounds. In the current embodiment, the sequence of annotated text segments comprises a listing of phonemes (sometimes called phones) plus pitch and duration values. However other speech segments (e.g., syllables or diphones) could easily be used, together with other information (e.g., volume).

Also shown in FIG. 2 is a process dispatcher 230. This is used to control the operation of the linguistic and acoustic processors, and more particularly their mutual interaction. Thus the process dispatcher effectively regulates the overall operation of the system. This is achieved by sending messages between the applications as shown by the arrows A–D in FIG. 2 (such interprocess communication is well-known to the person skilled in the art).

When the TTS system is started, the acoustic processor sends a message to the process dispatcher (arrow D), requesting appropriate input data. The process dispatcher in turn forwards this request to the linguistic processor (arrow A), which accordingly processes a suitable amount of input text. The linguistic processor then notifies the process dispatcher that the next unit of output annotated text is available (arrow B). This notification is forwarded onto the acoustic processor (arrow C), which can then obtain the appropriate annotated text from the linguistic processor.

It should be noted that the return notification provided by arrows B and C is not necessary, in that once further data has been requested by the acoustic processor, it could simply poll the output stage of the linguistic processor until such data becomes available. However, the return notification indicated firstly avoids the acoustic processor looking for data that has not yet arrived, and also permits the process dispatcher to record the overall status of the system. Thus the process dispatcher stores information about each incomplete request (represented by arrows D and A), which can then be matched up against the return notification (arrows B and C).

Figure 3:
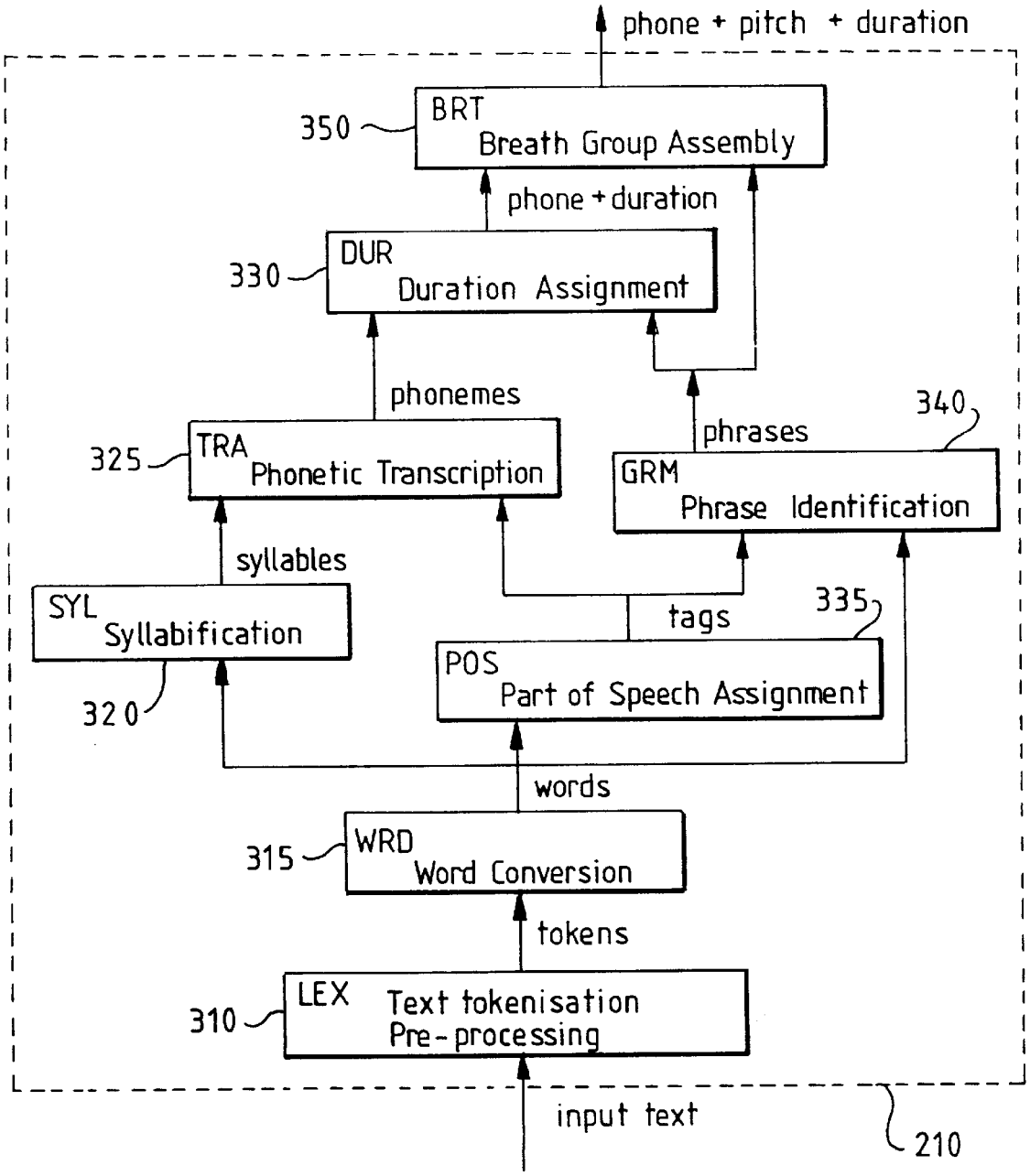
FIG. 3 is a diagram showing the components of the linguistic processor of FIG. 2.

FIG. 3 illustrates the structure of the linguistic processor 210 itself, together with the data flow internal to the linguistic processor. It should be appreciated that this structure is well-known to those working in the art; the difference from known systems lies not in identity or function of the components, but rather in the way that the flow of data between them is controlled. For ease of understanding the components will be described by the order in which they are encountered by input text, i.e., following the "sausage machine" approach of the prior art, although as will be explained later, the operation of the linguistic processor is driven in a quite distinct manner.

The first component 310 of the linguistic processor (LEX) performs text tokenisation and pre-processing. The function of this component is to obtain input from a source, such as the keyboard or a stored file, performing the required IO operations, and to split the input text into tokens (words), based on spacing, punctuation, and so on. The size of input can be arranged as desired; it may represent a fixed number of characters, a complete sentence or line of text (i.e., until the next full stop or return character respectively), or any other appropriate segment. The next component 315 (WRD) is responsible for word conversion. A set of ad hoc rules are implemented to map lexical items into canonical word forms. Thus for examples numbers are converted into word strings, and acronyms and abbreviations are expanded. The output of this state is a stream of words which represent the dictation form of the input text, that is, what would have to be spoken to a secretary to ensure that the text could be correctly written down. This needs to include some indication of the presence of punctuation.

The processing then splits into two branches, essentially one concerned with individual words, the other with larger grammatical effects (prosody). Discussing the former branch first, this includes a component 320 (SYL) which is responsible for breaking words down into their constituent syllables. Normally this is done using a dictionary look-up, although it is also useful to include some back-up mechanism to be able to process words that are not in the dictionary. This is often done for example by removing any possible prefix or suffix, to see if the word is related to one that is already in the dictionary (and so presumably can be disaggregated into syllables in an analogous manner). The next component 325 (TRA) then performs phonetic transcription, in which the syllabified word is broken down still further into its constituent phonemes, again using a dictionary look-up table, augmented with general purpose rules for words not in the dictionary. There is a link to a component POS on the prosody branch, which is described below, since grammatical information can sometimes be used to resolve phonetic ambiguities (e.g., the pronunciation of "present" changes according to whether it is a vowel or a noun). Note that it would be quite possible to combine SYL and TRA into a single processing component.

The output of TRA is a sequence of phonemes representing the speech to be produced, which is passed to the duration assignment component 330 (DUR). This sequence of phonemes is eventually passed from the linguistic processor to the acoustic processor, along with annotations describing the pitch and durations of the phonemes. These annotations are developed by the components of the linguistic processor as follows. Firstly the component 335 (POS) attempts to assign each word a part of speech. There are various ways of doing this: one common way in the prior art is simply to examine the word in a dictionary. Often further information is required, and this can be provided by rules which may be determined on either a grammatical or statistical basis; e.g., as regards the latter, the word "the" is usually followed by a noun or an adjective. As stated above, the part of speech assignment can be supplied to the phonetic transcription component (TRA).

The next component 340 (GRM) in the prosodic branch determines phrase boundaries, based on the part of speech assignments for a series of words; e.g., conjunctions often lie at phrase boundaries. The phrase identifications can use also use punctuation information, such as the location of commas and full stops, obtained from the word conversion component WRD. The phrase identifications are then passed to the breath group assembly unit BRT as described in more detail below, and the duration assignment component 330 (DUR) . The duration assignment component combines the phrase information with the sequence of phonemes supplied by the phonetic transcription TRA to determine an estimated duration for each phoneme in the output sequence. Typically the durations are determined by assigning each phoneme a standard duration, which is then modified in accordance with certain rules, e.g., the identity of neighboring phonemes, or position within a phrase (phonemes at the end of phrases tend to be lengthened). An alternative approach using a Hidden Markov model (HMM) to predict segment durations is described in co-pending application GB 9412555.6 (UK9-94-007).

The final component 350 (BRT) in the linguistic processor is the breath group assembly, which assembles sequences of phonemes representing a breath group. A breath group essentially corresponds to a phrase as identified by the GRM phase identification component. Each phoneme in the breath group is allocated a pitch, based on a pitch contour for the breath group phrase. This permits the linguistic processor to output to the acoustic processor the annotated lists of phonemes plus pitch and duration, each list representing one breath group.

Figure 4:
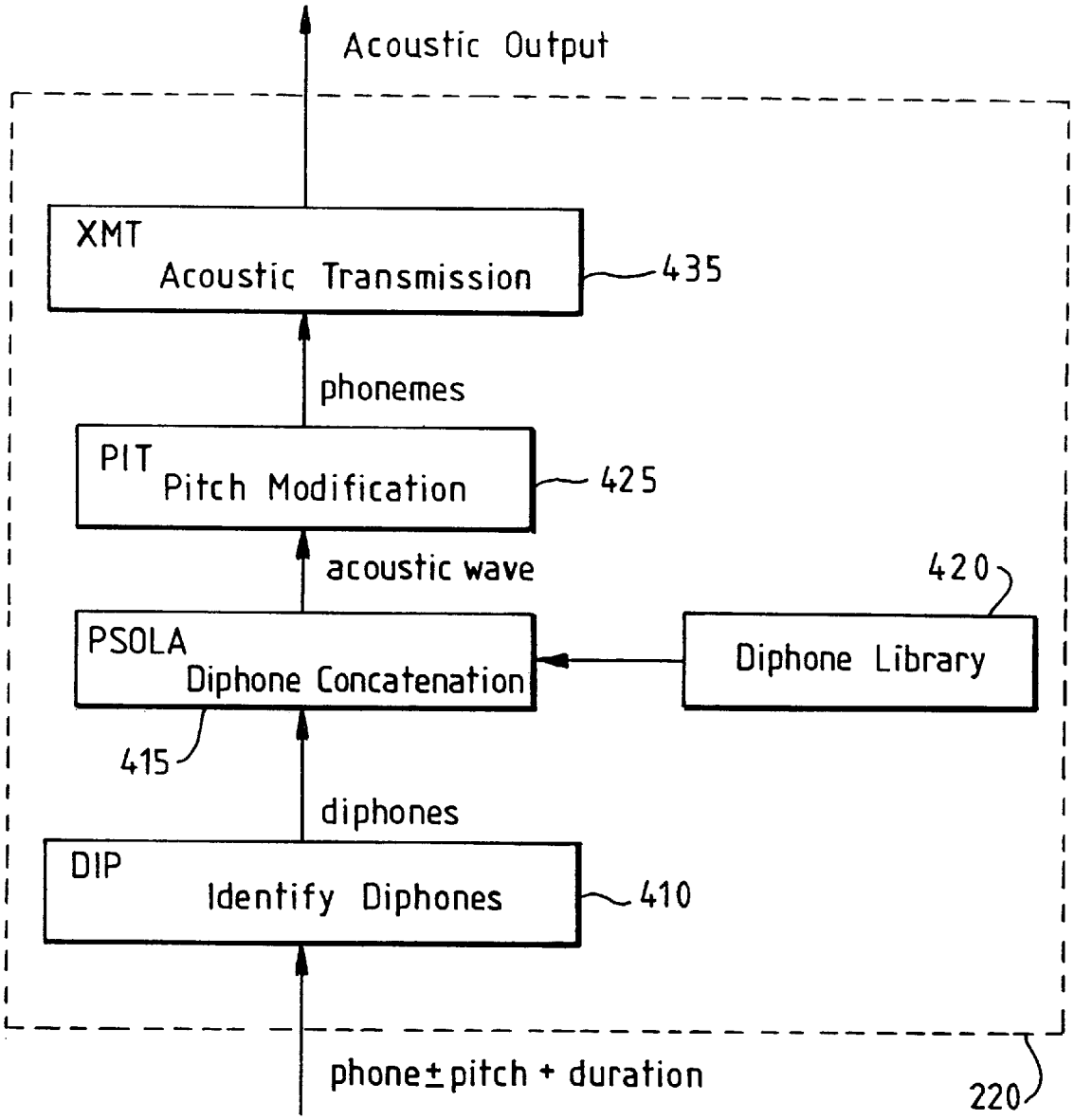
FIG. 4 is a diagram showing the components of the acoustic processor of FIG. 2.

Turning now to the acoustic processor this is shown in more detail in FIG. 4. The components of the acoustic processor are conventional and well-known to the skilled person. A diphone library 420 effectively contains prerecorded segments of diphones (a diphone represents the transition between two phonemes). Often many samples of each diphone are collected, and these are statistically averaged for use in the diphone library. Since there are about 50 common phonemes, the diphone library potentially has about 2500 entries, although in fact not all phoneme combinations occur in natural speech.

Thus once the acoustic processor has received the list of phonemes, the first stage 410 (DIP) identifies the diphones in this input list, based simply on successive pairs of phonemes. The relevant diphones are then retrieved from the diphone library and are concatenated together by the diphone concatenation unit 415 (PSOLA). Appropriate interpolation techniques are used to ensure that there is no audible discontinuity between diphones, and the length of this interpolation can be controlled to ensure that each phoneme has the correct duration as specified by the linguistic processor. "PSOLA", which stands for pitch synchronous overlap-add represents a particular form of synthesis (see "Pitch-synchronous waveform processing techniques for text-to-speech synthesis using diphones", Carpentier and Moulines, In Proceedings Eurospeech 89 (Paris, 1989), p 13–19, or "A diphone Synthesis System based on time-domain prosodic modifications of speech" by Hamon, Moulines, and Charpentier, in ICASSP 89 (1989), IEEE, p 238–241 for more details); any other suitable synthesis technique could also be used. The next component 425 (PIT) is then responsible for modifying the diphone parameters in accordance with the required pitch, whilst the final component 435 (XMT) is a device transmitter which produces the acoustic waveform to drive a loudspeaker or other audio output device. In the current implementation PIT and XMT have been combined into a single step which generates the waveform distorted in both pitch and duration dimensions.

The output unit provided by each component is listed in Table 1. One such output is provided upon request as input to the following stage, except of course for the final stage XMT which drives a loudspeaker in real-time and therefore must produce output at a constant data rate. Note that the output unit represents the size of the text unit (e.g., word, sentence, phoneme); for many stages this is accompanied by additional information for that unit (e.g., duration, part of speech etc.).

TABLE 1

| Linguistic Processor | | Acoustic Processor | |
|---|---|---|---|
| Component | Output | Component | Output |
| LEX | Token (word) | DIP | Diphones |
| WRD | Word | PSOLA | Wavelengths |
| SYL | Syllable | PIT | Phoneme |
| TRA | Phoneme | XMT | Continuous |
| DUR | Phoneme | | Audio |
| POS | Word | | |
| GRM | Phrase | | |
| BRT | Breath Group | | |

Figure 5:
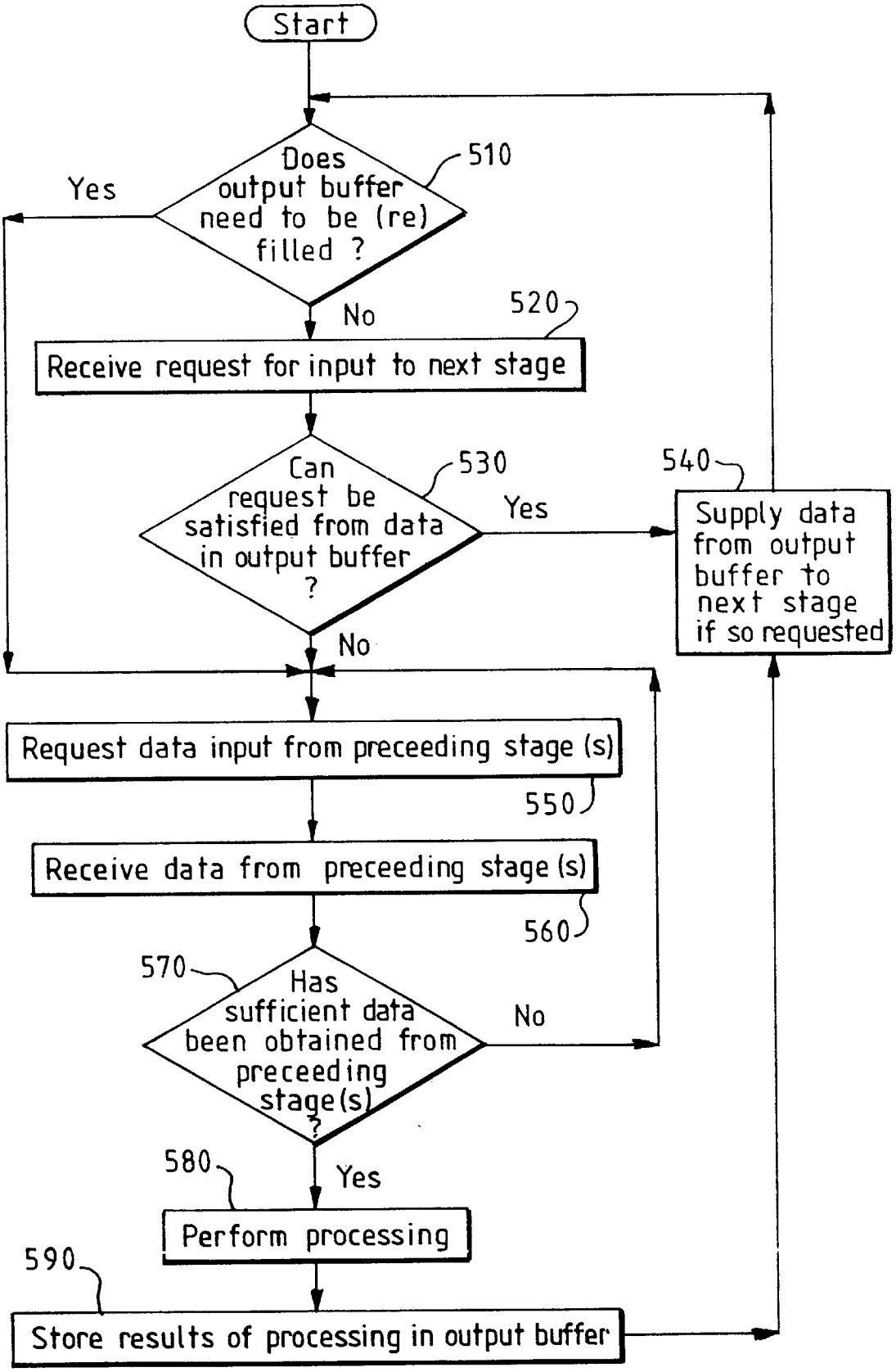
FIG. 5 is a flow chart showing the control operations in the TTS system.

It should be appreciated that both the structure of the linguistic and acoustic processors need not match those described above. The prior art (see the book "Talking Machines" and the paper by Klatt referred to above) provides many possible arrangements, all of which are well-known to the person skilled in the art. The present invention does not affect the nature of these components, nor their actual input or output in terms of phonemes, syllabified words or whatever. Rather, the present invention is concerned with how the different components FIG. 5 is a flow chart depicting this control of data flow through a component of the TTS system. This flow chart depicts the operation both of the high-level linguistic/acoustic processors, and of the lower-level components within them. The linguistic processor can be regarded for example as a single component which receives input text in the same manner as the text tokenisation component, and outputs it in the same manner as the breath group assembly component, with "black box"0 processing inbetween. In such a situation it is possible that the processing within the linguistic or acoustic processor is conventional, with the approach of the present invention only being used to control the flow of data between the linguistic and acoustic processors.

An important aspect of the TTS system is that it is intended to operate in real-time. Thus the situation should be avoided where the acoustic processor requests further data from the linguistic processor, but due to the computational time within the linguistic processor, the acoustic processor runs out of data before this request can be satisfied (which would result in a gap in the speech output). Therefore, it may be desirable for certain components to try to buffer a minimum amount of output data, so that future requests for data can be supplied in a timely manner. Components such as the breath group assembly BRT which output relatively large data units (see Table 1) generally are more likely to require such a minimum amount of output buffer data, whilst other units may well have no such minimum amount. Thus the first step 510 shown in FIG. 5 represents a check on whether the output buffer for the component contains sufficient data, and will only be applicable to those components which specify a minimum amount here. The output buffer may be below this minimum either at initialization, or following the supply of data to the following stage. If filling of the output is required, this is performed as described below.

Note that the output buffer is also used when a component produces several output units for each input unit that it receives. For example, the Syllabification component may produce several syllables from each unit of input (i.e., word) that it receives from the preceding stage. These can then be stored in the output buffer for access one at a time by the next component (Phonetic Transcription).

The next step 520 is to receive a request from the next stage for input (this might arrive when the output buffer is being filled, in which case it can be queued). In some cases, the request can be satisfied from data already present in the output buffer (cf step 530), in which case the data can be supplied accordingly (step 540) without further processing. However, if this is not the case, it is necessary to request input (step 550) from the immediately preceding stage or stages. Thus for example the Phonetic Transcription may need data from both the Part of Speech Assignment and Syllabification components. When the request or requests have been satisfied (step 560), a check is made as to whether the component now has sufficient input data (step 570); if not, it must keep requesting input data. Thus for example the Breath Group Assembly component would need to send multiple requests, each for a single phoneme, to the Duration Assignment component, until a whole breath group could be assembled. Similarly the part of speech assignment POS will normally require a whole phrase or sentence, and so will repeatedly request input until a full stop or other appropriate delimiter is encountered. Once sufficient data has been obtained, the component can then perform the relevant processing (step 580), and store the results in the output buffer (step 590). They can then be supplied to the next stage (540), in answer to the original request of step 520, or stored to answer a future such request. Note that the supplying step 540 may comprise sending a response to the requesting component, which then accesses the output buffer to retrieve the requested data.

There is a slight complication when a component sends output or receives input from more than one stage, but this can be easily handled, given the sequential nature of text. Thus if a component supplies output to two other components, it can maintain two independent output buffers, copying the results of its processing into both. If a component receives input from two components, it may need to request input from both before it can start processing. One input can be buffered if it relates to a larger text unit than the other input.

Although not specifically shown in FIG. 5, all requests (steps 520 and 550) are routed via a process dispatcher, which can keep track of outstanding requests. Similarly, the supply of data to the following stage (steps 560 and 540) is implemented by first sending a notification to the requesting stage via the process dispatcher that the data is available. The requesting stage then acts upon this notification to collect the data from the preceding stage.

The TTS system with the architecture described above is started and stopped in a rather different manner from normal. Thus rather than pushing input text into it, once a start command has been received (e.g., by the process dispatcher) it is routed to the acoustic processor, possibly to its last component. This then results in a request being passed back to the preceding component, which then cascades the request back until the input stage is reached. This then results in the input of data into the system. Similarly, a command to stop processing is also directed to the end of the system, whence it propagates backwards through the other components.

The text to speech system described above retains maximum flexibility, since any algorithm or synthesis technique can be adopted, but is particularly suited to commercial use given its precise control and economical processing.

I claim:

1. A text to speech (TTS) system for converting input text into an output acoustic signal simulating natural speech, the text to speech system comprising: a linguistic processor for generating a listing of speech segments plus associated parameters from the input text, and an acoustic processor for generating the output acoustic waveform from said listing of speech segments plus associated parameters;

said system being characterized in that it is output driven, wherein the acoustic processor sends a request to the linguistic processor whenever it needs to obtain a further listing of speech segments plus associated parameters, the linguistic processor processing input text in response to such requests.

2. The TTS system of claim 1, wherein if the TTS system receives a command to stop producing output speech, this command is forwarded first to the acoustic processor.

3. The TTS system of claim 1, wherein the linguistic processor sends a response to the request from the acoustic processor to indicate the availability of a further listing of speech segments plus associated parameters.

4. The TTS system of claim 1, wherein the TTS system further includes a process dispatcher acting as an intermediary between the acoustic processor and the linguistic processor, whereby said requests and said response are routed via the process dispatcher.

5. The TTS system of claim 4, wherein the process dispatcher maintains a list of requests that have not yet received responses.

6. The TTS system of claim 1, wherein at least one of the acoustic and linguistic processor comprise a plurality of stages arranged sequentially from the input to the output, each stage being responsive to a request from the following stage to perform processing.

7. The TTS system of claim 6, wherein the size of output varies across said plurality of stages.

8. The TTS system of claim 1, wherein the TTS system includes two microprocessors, the linguistic processor operating on one microprocessor, the acoustic processor operating essentially in parallel therewith on the other microprocessor.

9. The TTS system of claim 1, wherein the acoustic processor obtains speech segments corresponding to one breath group from the linguistic processor for each request.

* * * * *